US011643264B2

(12) United States Patent
Dupree

(10) Patent No.: US 11,643,264 B2
(45) Date of Patent: May 9, 2023

(54) PLASTIC BOTTLE AND STRAW ASSEMBLY

(71) Applicant: Edith Evelith Dupree, Fayetteville, NC (US)

(72) Inventor: Edith Evelith Dupree, Fayetteville, NC (US)

( * ) Notice: Subject to any disclaimer, the term of this patent is extended or adjusted under 35 U.S.C. 154(b) by 117 days.

(21) Appl. No.: 17/376,820

(22) Filed: Jul. 15, 2021

(65) Prior Publication Data

US 2023/0017896 A1 Jan. 19, 2023

(51) Int. Cl.
*B65D 77/28* (2006.01)
*A47G 21/18* (2006.01)
*A45F 3/18* (2006.01)

(52) U.S. Cl.
CPC ..... *B65D 77/286* (2013.01); *A45F 3/18* (2013.01); *A47G 21/18* (2013.01)

(58) Field of Classification Search
CPC ..... B65D 51/24; B65D 77/286; B65D 77/28; B65D 77/225; A47G 21/18; A47G 21/186; A47G 19/2222; A47G 19/2266; A45F 3/18; A45F 3/16
USPC ..... 215/389, 388, 387, 229, 228; 220/710, 220/705, 212
See application file for complete search history.

(56) References Cited

U.S. PATENT DOCUMENTS 1,364,889 A * 1/1921 Rupp ..... A47G 19/12 222/88
D279,250 S * 6/1985 Holloway ..... D7/300.2
4,573,631 A * 3/1986 Reeves ..... B65D 77/283 229/404
6,142,326 A 11/2000 Cornell et al.
6,196,413 B1 3/2001 Tung
7,021,490 B2 * 4/2006 Lipson ..... A47G 21/182 220/709
2007/0034594 A1 * 2/2007 Doucet ..... A47G 19/2266 215/229
2013/0240545 A1 * 9/2013 O'Sullivan ..... A47G 19/2222 220/710

FOREIGN PATENT DOCUMENTS

WO WO-0027258 A1 * 5/2000 ..... A47G 19/2227

* cited by examiner

*Primary Examiner* — Robert J Hicks
(74) *Attorney, Agent, or Firm* — James G. Passe; Passe Intellectual Property, LLC

(57) ABSTRACT

A plastic bottle and straw assembly wherein the plastic bottle has a built-in straw for drinking a liquid and is embedded through the bottom of the bottle from the outside, is sealed to prevent leakage, and solves the problem of having separate pieces and allows a user to not be required to tilt their head back to access a liquid.

2 Claims, 3 Drawing Sheets

PLASTIC BOTTLE AND STRAW ASSEMBLY

COPYRIGHT NOTICE

A portion of the disclosure of this patent contains material that is subject to copyright protection. The copyright owner has no objection to the reproduction by anyone of the patent document or the patent disclosure as it appears in the Patent and Trademark Office patent files or records, but otherwise reserves all copyright rights whatsoever.

BACKGROUND OF THE INVENTION

Field of the Invention

The present invention relates to a plastic bottle and straw assembly. In particular, it relates to a plastic bottle with a built-in straw pre-positioned for drinking.

Description of Related Art

Plastic bottles for containing a liquid like water, and the like, rely on the opening of the bottle cap to access the liquid and then tipping the bottle and head back in order to drink from the bottle. A drinking straw solves some of these problems. By inserting the straw into the open bottle top, one can drink the water or other liquid without tipping the bottle or the head. This, however, creates the problem of having to carry both a plastic bottle and a straw.

Several attempts have been made to solve the bottle-straw assembly issue. Mostly they involve pre-positioning a straw in the open top and then withdrawing it. Others merely removably attach the straw to the side of the bottle. However, this still requires the positioning of the straw and opening the top of the bottle. This means an individual has a bottle top separate from the bottle and a straw leaving the user with the inconvenient problem of managing the separate pieces.

BRIEF SUMMARY OF THE INVENTION

The present invention relates to a plastic bottle with a straw embedded through the bottom of the bottle from the outside. The straw is then curved to attach to the side of the bottle and sealed with a device to prevent liquid from escaping from the straw until a user is ready to drink. In this case, the bottle cap does not have to be removed to take a drink and a user can drink without having to tip the plastic bottle.

Accordingly, in one embodiment, there is a plastic bottle and straw assembly for drinking a liquid from the plastic bottle comprising:

1. an upright plastic bottle with a side, a bottom, a chamber holding the liquid, and a top cap for accessing the liquid inside the upright plastic bottle; and
2. a drinking straw, wherein a first end is positioned in the bottle chamber at the bottom of the bottle, the straw passes through the bottle side, sealed to prevent leakage, and is bent upwards to lay next to the side of the bottle, and having a second end designed for drinking from the upright plastic bottle, the straw openably sealed to contain the liquid until the straw is used by a user.

DETAILED DESCRIPTION OF THE INVENTION

Figure 1:
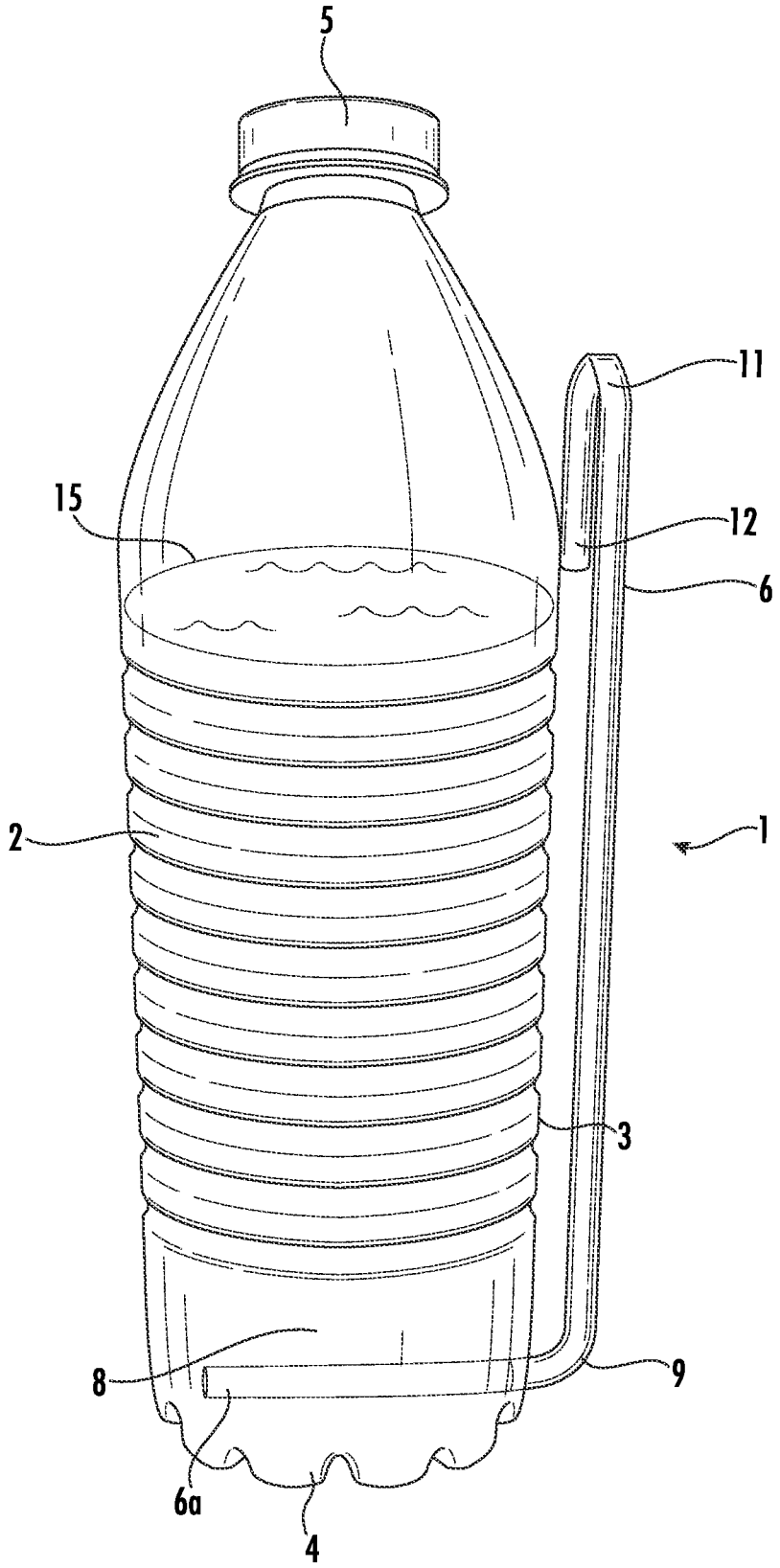
FIG. 1 is a side view of the plastic bottle straw assembly of the present invention.

While this invention is susceptible to embodiment in many different forms, there is shown in the drawings, and will herein be described in detail, specific embodiments with the understanding that the present disclosure of such embodiments is to be considered as an example of the principles and not intended to limit the invention to the specific embodiments shown and described. In the description below, like reference numerals are used to describe the same, similar, or corresponding parts in the several views of the drawings. This detailed description defines the meaning of the terms used herein and specifically describes embodiments in order for those skilled in the art to practice the invention.

Definitions

The terms "about" and "essentially" mean±10 percent.

The terms "a" or "an", as used herein, are defined as one or as more than one. The term "plurality", as used herein, is defined as two or as more than two. The term "another", as used herein, is defined as at least a second or more. The terms "including" and/or "having", as used herein, are defined as comprising (i.e., open language). The term "coupled", as used herein, is defined as connected, although not necessarily directly, and not necessarily mechanically.

The term "comprising" is not intended to limit inventions to only claiming the present invention with such comprising language. Any invention using the term comprising could be separated into one or more claims using "consisting" or "consisting of" claim language and is so intended.

Reference throughout this document to "one embodiment", "certain embodiments", "an embodiment", or similar terms means that a particular feature, structure, or characteristic described in connection with the embodiment is included in at least one embodiment of the present invention. Thus, the appearances of such phrases in various places throughout this specification are not necessarily all referring to the same embodiment. Furthermore, the particular features, structures, or characteristics may be combined in any suitable manner in one or more embodiments without limitation.

The term "or", as used herein, is to be interpreted as an inclusive or meaning any one or any combination. Therefore, "A, B, or C" means any of the following: "A; B; C; A and B; A and C; B and C; A, B, and C". An exception to this definition will occur only when a combination of elements, functions, steps, or acts are in some way inherently mutually exclusive.

The drawings featured in the figures are for the purpose of illustrating certain convenient embodiments of the present invention and are not to be considered as limitation thereto. The term "means" preceding a present participle of an operation indicates a desired function for which there is one or more embodiments, i.e., one or more methods, devices, or apparatuses for achieving the desired function and that one skilled in the art could select from these or their equivalent in view of the disclosure herein, and use of the term "means" is not intended to be limiting.

As used herein, the term "upright plastic bottle" refers to an upright container (taller than it is wide, see FIG. 1 for an example) containing a drinkable liquid in a chamber. The upright plastic bottle will also have a side, a bottom, and a top cap for removing the liquid in the normal manner once the top cap is removed.

As used herein, the term "side" refers to the side of the bottle in an upright position from the bottom of the bottle to the top cap.

As used herein, the term "bottom" refers to the bottom of the upright plastic bottle both on the outside of the bottle and inside the chamber.

As used herein, the term "chamber" refers to the inside of the upright plastic bottle where liquid for drinking is positioned.

As used herein, the term "top cap" refers to a removable cap located at the top of the upright plastic bottle designed for opening and closing the bottle.

As used herein, the term "drinking straw" refers to a long, thin, hollow paper, plastic, or metal tube used for siphoning liquids into the mouth.

As used herein, the term "bent upwards" refers to the straw being bent upwards where it exits the chamber so that a portion runs along the side of the bottle. In one embodiment, the straw is bent outwardly for the user to drink from. Bends can be permanently made during the manufacturing of the straw, but can also be the bendable straws, which are well known in the art.

As used herein, the term "openably sealed" refers to the straw being sealed in a manner to prevent liquid from leaking out of the top of the straw, but the seal is removable or openable when a user is drinking from the straw. In one embodiment, it is also resealable. Sealing can be accomplished by any method (e.g., by use of a plug or by folding over the tip of the straw).

As used herein, the term "drinking" refers to a user's action of sucking liquid from the bottle through the straw.

As used herein, the term "folding" refers to folding the second end of the drinking straw over onto itself in order to seal the straw until use. See FIG. 3 for a representative example.

As used herein, the term "straw assembly" refers to the combination of an upright bottle with a liquid inside the bottle chamber and a drinking straw positioned for use in removing the liquid from the chamber without removing the top cap.

As used herein, the term "liquid" refers to any drinkable liquid compatible with the plastic used in the upright plastic bottle. These liquids include, but are not limited to water, soda, vegetable juice, fruit juice, and the like.

As used herein, the term "user" refers to an individual taking a drink from the plastic bottle and straw assembly.

DRAWINGS

Now referring to the drawings, FIG. 1 is a frontal view of the plastic bottle and straw assembly 1 of the present invention. It consists of an upright plastic bottle 2 (clear in this embodiment), the bottle side 3, bottom 4, and the top cap 5 for opening the plastic bottle 2 at the top. The drinking straw 6 passes through the bottle side 3 in a sealed manner, with the first end 6*a* positioned into chamber 8. It rests at the bottom of chamber 8 in order to be able to remove essentially all of the drinking liquid 15 from the chamber. The drinking straw 6 is bent upward 9 and travels along the bottle side 3 until it reaches point 11, where the drinking straw is bent to an angle that allows for drinking from second end 12, while the plastic bottle 2 remains upright.

Figure 2:
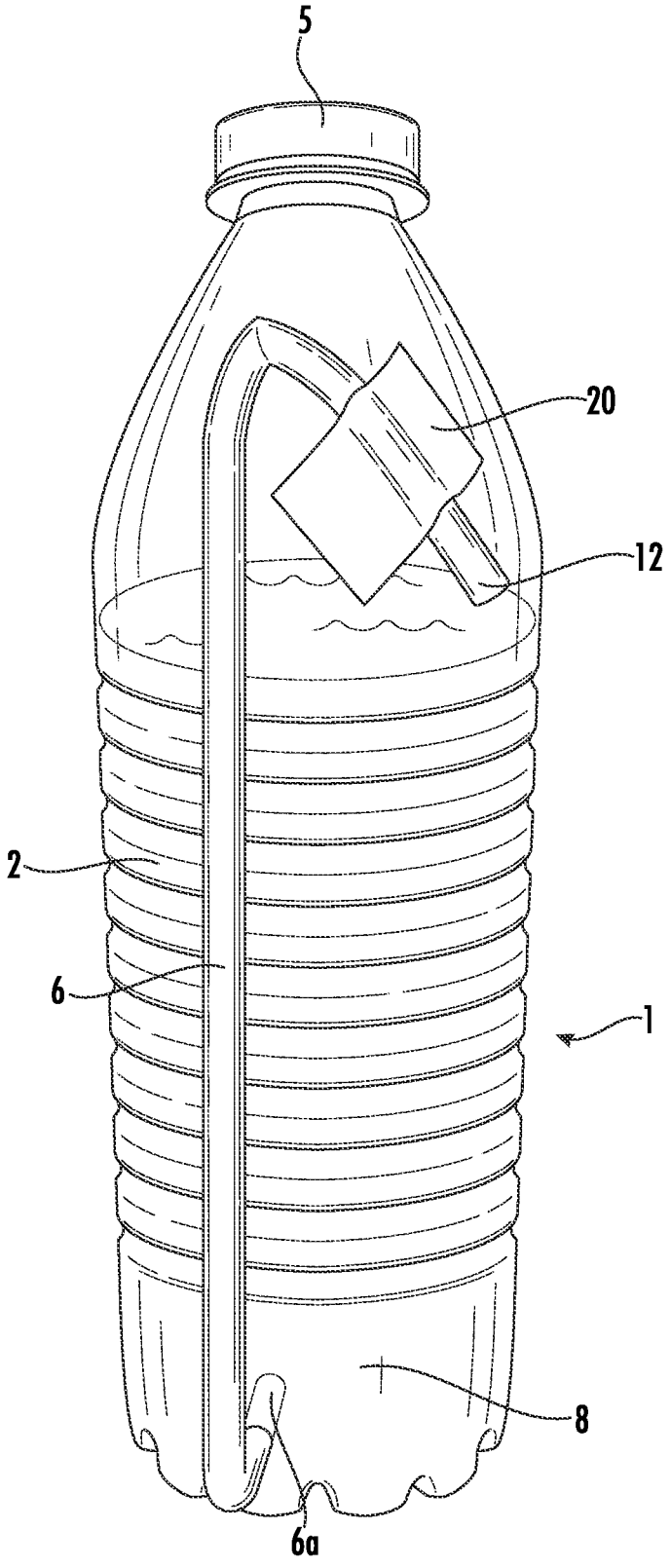
FIG. 2 is a side view of the plastic bottle and straw assembly with the straw second end attached to the side of the bottle of the present invention.

FIG. 2 shows the plastic bottle 2 from the position where the second end 12 can clearly be seen. In this view, the drinking straw 6 is taped 20 to the plastic bottle 2 to prevent it from moving until the user desires to utilize the drinking straw 6 to drink.

Figure 3:
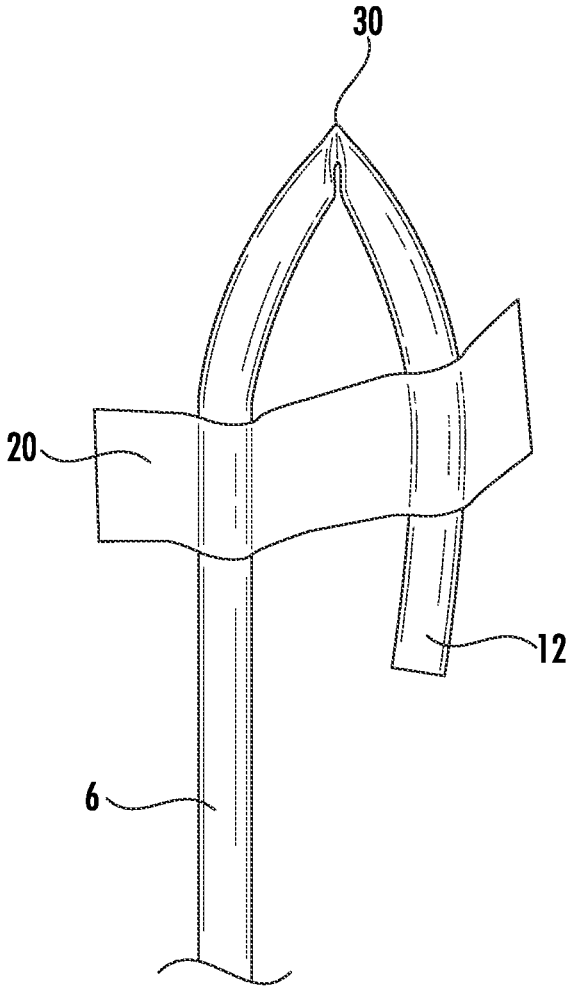
FIG. 3 is an isolated view of the drinking straw of the present invention.

FIG. 3 isolates the second end 12 of drinking straw 6. In this view, the second end 12 of drinking straw 6 is bent over far enough to create kink 30, which prevents liquid from exiting the drinking straw if the plastic bottle 2 is tipped from its upright position. The drinking straw is again taped 20 to hold the second end 12 in place. To use the straw, the tape is merely removed. It should be noted the tape 20 can be completely removable or have a means for attaching the straw in a fixed position on the side of the bottle.

Those skilled in the art to which the present invention pertains may make modifications resulting in other embodiments employing principles of the present invention without departing from its spirit or characteristics, particularly upon considering the foregoing teachings. Accordingly, the described embodiments are to be considered in all respects only as illustrative, and not restrictive, and the scope of the present invention is, therefore, indicated by the appended claims rather than by the foregoing description or drawings. Consequently, while the present invention has been described with reference to particular embodiments, modifications of structure, sequence, materials, and the like apparent to those skilled in the art still fall within the scope of the invention as claimed by the applicant.

What is claimed is:

1. A plastic bottle and straw assembly for drinking a liquid from the plastic bottle consisting of:

a) an upright plastic bottle with a side, a bottom, a chamber holding the liquid, and a top cap for accessing the liquid inside the upright plastic bottle chamber; and b) a drinking straw, wherein a first end is positioned in the bottle chamber at the bottom of the bottle, the straw passes through the bottle side, wherein the bottle where the straw passes through the side of the bottle is sealed in a manner to prevent the liquid from leaking out of the bottle, and the straw is bent upwards to lay next to the outside of the bottle, the straw having a second end designed for drinking from the upright plastic bottle, and wherein the straw is sealed by folding the second end over to create a kink and then attaching the second end to the outside of the bottle to contain the liquid until the straw is opened by a user and wherein the straw does not pass through the top cap.

2. The plastic bottle and straw assembly for drinking a liquid from the plastic bottle according to claim 1, wherein the liquid is water.

* * * * *